US011511975B2

(12) United States Patent
Wiedemann et al.

(10) Patent No.: US 11,511,975 B2
(45) Date of Patent: Nov. 29, 2022

(54) APPARATUS AND METHOD FOR GUYING, IN THE AIR ASSEMBLY, AND RESTORATION OF A LATTICE BOOM

(71) Applicant: Liebherr-Werk Ehingen GmbH, Ehingen/Donau (DE)

(72) Inventors: Ulrich Wiedemann, Ulm (DE); Sergej Minenko, Ehingen (DE); Steffen Schwertle, Ehingen (DE); Alex Fischer, Mietingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 48 days.

(21) Appl. No.: 17/315,189

(22) Filed: May 7, 2021

(65) Prior Publication Data

US 2021/0347615 A1 Nov. 11, 2021

(30) Foreign Application Priority Data

May 8, 2020 (DE) ..... 10 2020 112 526.7

(51) Int. Cl.
*B66C 23/70* (2006.01)
*B66C 23/82* (2006.01)
*B66C 23/42* (2006.01)

(52) U.S. Cl.
CPC ..... *B66C 23/70* (2013.01); *B66C 23/82* (2013.01); *B66C 23/42* (2013.01)

(58) Field of Classification Search
CPC ..... B66C 23/70; B66C 23/82; B66C 1/10; B66C 1/12
See application file for complete search history.

(56) References Cited

U.S. PATENT DOCUMENTS 5,037,151 A * 8/1991 Kameyama ..... B66C 1/12 294/81.61
5,863,085 A * 1/1999 Khachaturian ..... B66C 1/12 294/81.1

(Continued)

FOREIGN PATENT DOCUMENTS

DE 10351487 A1 * 5/2005 ..... B66C 1/10
DE 102012022621 A1 5/2014

(Continued)

OTHER PUBLICATIONS

DE 10351487A1 Machine Translation (Year: 2005).*

*Primary Examiner* — Michael R Mansen
*Assistant Examiner* — Juan J Campos, Jr.
(74) *Attorney, Agent, or Firm* — McCoy Russell LLP

(57) ABSTRACT

The present apparatus relates to an apparatus for the guying of a lattice boom of a crane, in particular of a mobile crane, comprising a frame and two connection elements connected thereto, wherein the frame has first attachment means for a releasable connection of the apparatus to a guying of the crane and wherein the connection elements have two attachment means for a releasable fastening of the apparatus to the boom. In accordance with the invention, the apparatus can be assembled at the boom for assembly thereat and can be removed again after the boom has been assembled. The present invention further relates to a respective method for the in the air assembly and for the restoring to the original state and the guying of a lattice boom by means of the apparatus in accordance with the invention.

20 Claims, 7 Drawing Sheets

(56) References Cited

U.S. PATENT DOCUMENTS

| | | | | |
|---|---|---|---|---|
| 11,319,196 | B2 * | 5/2022 | Takaoka | B66C 23/82 |
| 2018/0105400 | A1 * | 4/2018 | Bakalyar | B66C 1/28 |
| 2019/0225461 | A1 * | 7/2019 | Bakalyar | B66C 1/28 |
| 2021/0171323 | A1 * | 6/2021 | Takaoka | B66C 23/36 |

FOREIGN PATENT DOCUMENTS

| | | | |
|---|---|---|---|
| EP | 3705446 | A1 | 9/2020 |
| WO | 2019111642 | A1 | 6/2019 |

* cited by examiner

APPARATUS AND METHOD FOR GUYING, IN THE AIR ASSEMBLY, AND RESTORATION OF A LATTICE BOOM

CROSS REFERENCE TO RELATED APPLICATION

The present application claims priority to German Patent Application No. 10 2020 112 526.7 filed on May 8, 2020. The entire contents of the above-listed application is hereby incorporated by reference for all purposes.

TECHNICAL FIELD

The present invention relates to an apparatus for the guying of a lattice boom of a crane, in particular of a mobile crane or of a crawler crane, and respectively to a method for the in the air assembly and restoration and guying of such a lattice boom by means of said apparatus.

BACKGROUND

Mobile cranes having lattice booms typically have to be dismantled into a plurality of parts for transport due to the high weight and the large dimensions and have to be set up or equipped at the deployment site. It is known in this process to use the guying device(s) of the crane in the assembly of the boom. The boom can thereby be held in the air, that is remote from the ground, by the guying so that further boom parts such as lattice pieces and/or a boom head can be attached—a procedure that can also be called in the air assembly.

SUMMARY

It has previously been necessary for the in the air assembly of lattice booms, to integrate a special adapter in the boom that serves the guying of the boom during the in the air assembly and that subsequently remains in the boom during the total crane deployment.

An example of such a special adapter or of a special lattice piece 100 known from the prior art is shown in a perspective view in FIG. 1. The special lattice piece 100 is equipped with bolt points or attachment points 104 for an SA frame guying or a derrick guying 7 of a mobile crane or of a crawler crane and is reinforced in the region of the attachment points. Additional weight of the special lattice piece 100 in comparison with a standard lattice piece, that is shown in FIG. 2, is produced by this guying possibility and the region 102 reinforced for the force introduction of the guying 7. The total weight of the boom is thereby increased since the special lattice piece 100 permanently remains in the boom, which results in a reduced maximum payload of the crane.

A fixed position of the special adapter furthermore previously had to be specified in the boom since it remains in the boom after the boom assembly and is also used in crane operation. The thickness of the corner stem pieces of the special lattice piece in this process defines its position within the boom. Stronger or thicker corner stem pieces are installed at the start of the boom while weaker or thinner corner stem pieces are arranged further toward the end of the boom. In other words, the corner stem piece thickness of the boom typically reduces from the start toward the tip. As a rule, however, only one single special lattice piece having a fixed corner stem piece diameter is used. This means that the special lattice piece can only be installed at specific positions in the boom system. As a result, a use in the boom units is only possible with limitations.

It is therefore the underlying object of the present invention to overcome the aforesaid disadvantages and to improve the in the air assembly of a lattice boom with respect to flexibility and to the resulting boom weight.

This object is achieved in accordance with the invention by an apparatus for guying a lattice boom comprising at least two lattice pieces or a lattice mast boom of a crane, in particular of a mobile crane or of a crawler crane, having the features of claim 1, by a method for in the air assembly of such a lattice boom having the features of claim 9, and by a method of restoring to the original state and guying such a lattice boom having the features of claim 12.

The apparatus in accordance with the invention accordingly comprises a frame and two connection elements connected thereto, wherein the frame has first attachment means for a releasable connection of the apparatus to a guying of the crane and wherein the connection elements have two attachment means for a releasable fastening of the apparatus to the boom. The apparatus here can be attached to the boom for its assembly and can be removed again after the boom has been assembled.

The apparatus in accordance with the invention is therefore only used for the boom assembly. The apparatus is removed before the start of normal crane operation and is thus not part of the boom weight in crane operation.

Due to the use of the apparatus in accordance with the invention, a special adapter or special lattice piece to which a guying of the crane would have to be attached for the in the air assembly is no longer necessary. Instead, for the in the air assembly, the apparatus in accordance with the invention is simply temporarily attached to the boom and subsequently removed again so that no special piece remains in the final boom provided for crane use. The boom mass is thus reduced, whereby the boom length can be increased and/or the maximum payload of the crane can be increased.

The external apparatus in accordance with the invention furthermore enables boom units without a special piece bound to a specific position so that special units can be dispensed with. This greatly increases the flexibility of the in the air assembly. The total in the air assembly without a special adapter is also simpler since no additional piece has to be planned in the boom and so cannot be incorrectly installed.

Advantageous embodiments of the invention result from the dependent claims and from the following description.

The apparatus in accordance with the invention can advantageously be attached to any standard lattice piece or lattice adapter, which enables an extremely flexible deployment.

Provision is made in an embodiment that the frame is of a trapezoidal structure, with the first attachment means preferably being fastened to the short side of the frame and the connection elements being fastened to the long side of the frame. The frame can furthermore have one or more struts that extend, for example, between the short and long sides to increase the stability or stiffness of the apparatus. However, a different shape, for example a rectangular shape, of the frame is also conceivable. The apparatus is preferably axially symmetrical.

Provision is made in a further embodiment that the connection elements are rods. The connection elements here serve as guying rods and preferably extend substantially in parallel with one another. The connection elements can be shaped in one piece or can be assembled from a plurality of parts.

Provision is made in a further embodiment that the connection elements are pivotably fastened to the frame within a common plane. The connection elements can thereby be moved or pivoted outwardly to be able to fasten them externally to the boom and to be able to plug them on from the outside. The connection elements are preferably each fastened to the frame via a cruciform lug that has two pivot axes arranged perpendicular to one another. The connection elements can thereby be pivoted in two directions independently of one another, which increases the flexibility and tolerance with respect to production or installation inaccuracies on the attachment of the apparatus to the boom. The two pivot axes can be spaced apart from one another or can coincide and form a universal joint.

Provision is made in a further embodiment that the frame has third attachment means to fasten the apparatus to an auxiliary crane. The third attachment means are preferably arranged at the side of the frame or in the region of the first attachment means. The apparatus can thus be attached to or suspended at an auxiliary crane so that the apparatus can be raised to the boom by means of the auxiliary crane to fasten it there.

Provision is made in a further embodiment that the second attachment means are formed as reception holes that can be placed from the outside, in particular laterally, onto connection pins at connection points of two lattice pieces of the boom. Connection points are here the regions at which two lattice pieces are joined together or pinned. To pin the lattice pieces, connection means are provided at the end regions of each lattice piece that can be joined together and pinned. It can in this respect be fork elements or connection forks having reception holes through which the connection pins can be placed.

Provision is made in a further embodiment that at least two special pins are provided that can be used to pin two lattice pieces of the boom in connection means of the lattice pieces, with the special pins projecting laterally beyond the lattice pieces so that the reception holes of the connection elements can be placed on from the outside. The special pins preferably have the same diameter as the standard pins normally used to pin the lattice pieces. The standard pins can thereby simply be replaced with the special pins in accordance with the invention to later enable an attachment or a fastening of the connection elements of the apparatus in accordance with the invention.

Standard lattice pieces can thus still be used for the assembly of the boom without a modification of the boom or of the lattice pieces having to be made to enable a fastening of the apparatus in accordance with the invention. They can thus be attached to every standard lattice piece in principle. This makes the apparatus in accordance with the invention usable in a particularly flexible manner.

The special pins preferably have one or more securing means to prevent the special pins from slipping out of the connection means and/or the second attachment means from releasing from the special pins. For example, a respective first securing means can be provided for the inner end (i.e. the end facing in the direction of the lattice piece) of the special pin. The first securing means can comprise a sleeve that can be pushed onto the special pin from the inside and that serves as an abutment of the special pin at the connection means of the lattice pieces. The sleeve can have a bore that in the placed on state covers a first bore that in particular extends radially through the special pin. A first securing pin can furthermore be provided that can be pushed through the first bore and the sleeve and that comprises a linchpin by which the first securing pin is secured against slipping out of the first bore or the first sleeve. The first securing pin prevents the first sleeve from falling off the special pin.

A second securing means can furthermore be provided at the other, outwardly disposed end of the special pin and comprises a second sleeve that can be placed on from the outside and that comprises a second securing pin having a linchpin that, like the first securing means, can be placed, in particular radially, through a second bore in particular extending radially through the special pin and corresponding bores of the second sleeve. The second sleeve in particular serves as an abutment for the second attachment means of the apparatus placed onto the second pin so that in the fastened state the second attachment means and the coupled connection means of the connected lattice pieces are arranged between the secured first and second sleeves, whereby an unwanted release of the apparatus in accordance with the invention from the boom is prevented.

Provision is made in a further embodiment that the connection elements are respectively fastenable at at least two different positions at the frame so that the distance of the connection elements from one another is variable. The dimensioning of the apparatus in accordance with the invention can thereby be adapted simply and quickly to the width of the boom or lattice piece used. The apparatus in accordance with the invention can thus be used universally. The distances that can be set by replacing or reinstalling the connection elements can be adapted to the typical widths of standard lattice pieces.

Holders can be provided at the apparatus to support at least two special pins and preferably the corresponding components of the associated securing means such as sleeves, securing pins, and linchpins. The holders can be arranged at the frame.

The distance of the first attachment means can furthermore correspond to the distance of a guying of the crane, in particular of a derrick guying, an A frame guying, or an SA frame guying. The distance of the first attachment means is preferably smaller than the distance of the fastening points of the connection elements at the frame. The distance of the third attachment means can furthermore be smaller than the distance of the first attachment means.

The apparatus in accordance with the invention can be able to be dismantled into a plurality of individual parts for transport. The connection elements can, for example, be releasably fastened to the frame. The apparatus can furthermore have a length that substantially corresponds to the length of a lattice piece of the boom. The width of the apparatus can substantially correspond to the width of a lattice piece of the boom.

The present invention further relates to a method for the in the air assembly of a lattice boom of a crane, in particular of a mobile crane or of a crawler crane, by means of the apparatus in accordance with the invention. The method comprises the following steps:

connecting or pinning at least two lattice pieces of the boom to the crane and supporting the boom on the ground, for example directly on the ground or on a frame;

positioning the apparatus at the connection point of two lattice pieces of the boom, preferably by means of an auxiliary crane;

fastening the apparatus to the boom via the second attachment means of the connection elements and preferably releasing the connection to the auxiliary crane;

connecting a guying of the crane to the first attachment means of the apparatus;

raising the boom by means of the guying, with the apparatus being part of the guying;

installing at least one further component of the boom, in particular a lattice piece and/or a boom head, to the guyed boom;

supporting the boom, in particular on a frame;

dismantling the apparatus from the guying and the boom; and fastening the guying and/or a further guying to the boom and raising the boom by means of the guying.

The same advantages and properties result from the method in accordance with the invention as for the apparatus in accordance with the invention. The apparatus in accordance with the invention used in the method can be configured in accordance with any one of the advantageous embodiments described above.

Provision is made in an embodiment of the method in accordance with the invention that the step of connecting or pinning at least two lattice pieces of the boom to the crane takes place while using two special pins that are used to pin the lattice pieces into connection means of the lattice pieces. The special pins are in particular formed as described above, i.e. they project laterally beyond the lattice pieces in the pinned state so that the reception holes of the connection elements can be placed on from the outside.

The lattice pieces in particular have upper and lower connection means of which the upper connection means of the lattice pieces are pinned to one another by the special pins and the lower connection means are first not pinned to one another. The connection means are preferably configured as connection forks. The pinning of the lower connection means preferably only takes place in a later step after raising the boom.

The step of connecting or pinning at least two lattice pieces of the boom to the crane while using the special pins preferably comprises the leading together of the upper connection means (i.e. arranged at the upper side) of the lattice pieces, the pushing of the special pins into the connection means to establish an upper pinning, and the securing of the special pins by means of the above-described first securing means.

The step of fastening the apparatus to the boom via the second attachment means of the connection elements can further comprise the lateral placing of the second attachment means of the connection elements of the apparatus onto the special pin and the securing of the connection by means of the above-described second securing means. It may be necessary for the lateral placement of the connection elements onto the special pins to outwardly move or pivot the connection elements. For this purpose, the connection elements are preferably pivotably connected to the frame via corresponding joints or lugs.

Provision is made in a further embodiment that the two lattice pieces, in particular the lower connection means of the lattice pieces, are pinned to one another by means of further connection pins after the raising of the boom by means of the guying. They can be standard pins here.

Provision is made in a further embodiment that the apparatus is placed on one of the lattice pieces before the connection to the guying of the crane. For this purpose, the apparatus can, for example, have one or more feet or a rack at the frame so that it is disposed higher after the placement than guying rods that are fastened to the upper side of the lattice piece and that are used for the final guying of the boom after the in the air assembly. After the placement, the apparatus can be prepared for the pinning to the guying of the crane.

The apparatus in accordance with the invention can furthermore also again be placed on the lattice piece after the installation of the additional boom elements and the subsequent underpinning or supporting of the extended or finally equipped boom to be able to comfortably dismantle the apparatus from the boom. In particular the second securing means of each special pin is released for this purpose and the connection elements of the apparatus is removed from the special pins. The special pins preferably remain in the boom.

After the dismantling of the apparatus in accordance with the invention, it can be installed again at a different point, in particular at a further connection point of two lattice pieces, if a further extension of the boom is required. Alternatively, in particular with shorter boom systems, the in the air assembly of the boom can take place by a single attachment and dismantling of the apparatus in accordance with the invention.

Provision is made in a further embodiment that the guying is a derrick guying, an A frame guying, or an SA frame guying. Provision can be made that the same guying is used both for the raising of the boom that has not yet been equipped and for the raising and guying of the finally equipped boom. Furthermore, guying rods can be fastened to the upper sides of the lattice pieces for the final guying (which does not include the apparatus in accordance with the invention). After the dismantling of the apparatus in accordance with the invention, the guying of the crane can be connected to said guying rods that have been coupled to one another in the meantime and the finally equipped boom can be raised and moved into a working position after tensioning the guying.

The apparatus in accordance with the invention is generally suitable for the in the air assembly of a lattice boom, with the term "in the air assembly" having to be understood broadly and in the present case in particular designating any kind of conversion of the boom. Since the apparatus can be attached and dismantled at any desired connection point of two lattice pieces of the boom, it can be used for a plurality of conversion or equipping procedures. One example for this is the so-called restoring of the crane or boom to its original condition also simply called restoration herein.

The restored state of a crane is an operating mode without a boom head and is suitable for traveling the crane from one position to another position. The restoration typically takes place since the whole boom length may not be traveled in accordance with the operating instructions because the ground between the current position and the destination position cannot bear the total crane weight and/or to reduce the wear of the crane during traveling. When restoring the boom, the boom length by which the load is raised is restored to a smaller length. The boom head and typically one or more lattice pieces are removed. The boom state resulting from this without the boom head is called restored.

The boom weight becomes lighter due to the restoration and the total weight to be traveled is reduced. The aim of the restoration is therefore a smaller total weight and thereby less surface contact on the ground or a smaller wear. The restored boom furthermore has a lower center of gravity, which brings about advantages in stability.

Since the boom head is removed during restoration, the possibility is, however, lost, of guying the restored boom since the guying is typically fastened to the boom head. The special adapters known from the prior art were only able to be used at a specific position in the boom so that the restored boom could only be guyed at this point up to now. A restoration based on requirements was thus not achievable.

It is, however, actually possible with the apparatus in accordance with the invention to guy the lattice boom at any desired connection point of two lattice pieces, that is also in the restored state without a boom head.

For this reason, the present invention further relates to a method for the restoration and guying of a lattice boom of a crane, in particular of a mobile crane or of a crawler crane, by means of an apparatus in accordance with the invention. The method comprises the following steps:

placing the boom down, in particular on a placement frame, and dismantling a component of the boom, in particular the boom head and optionally one or more lattice pieces;

positioning the apparatus at the connection point of two lattice pieces of the boom, preferably by means of an auxiliary crane;

fastening the apparatus to the boom via the second attachment means of the connection elements and preferably releasing the connection to the auxiliary crane;

connecting a guying of the crane to the first attachment means of the apparatus; and raising the boom by means of the guying and guying the boom, with the apparatus being part of the guying.

Since the apparatus in accordance with the invention can be attached to any desired lattice piece of the restored boom, it can easily be reduced in length for guying and a boom not having a boom head can be used. The position of the guying, which also includes the apparatus in the method in accordance with the invention, is thus freely selectable and adaptable to the respective deployment situation and crane configuration. This makes a restoration based on requirements possible.

The apparatus in accordance with the invention used in the last described method can be configured in accordance with any one of the advantageous embodiments described above.

Provision is made in an embodiment, of the method in accordance with the invention that at least two lattice pieces of the boom are pinned by means of the previously described special pins to which the apparatus is fastened by the two attachment means of the connection elements.

Provision is made in a further embodiment that the apparatus is placed on one of the lattice pieces before the connection to the guying of the crane.

Provision is made in a further embodiment that the guying is a derrick guying, an A frame guying, or an SA frame guying.

The statements on the corresponding embodiments of the method in accordance with the invention for the in the air assembly apply to the three last named embodiments of the method for restoration and guying so that a repetition is dispensed with at this point.

BRIEF DESCRIPTION OF THE FIGURES

Further features, details, and advantages of the invention result from the embodiments explained in the following with reference to the Figures. There are shown.

DETAILED DESCRIPTION

Figure 1:
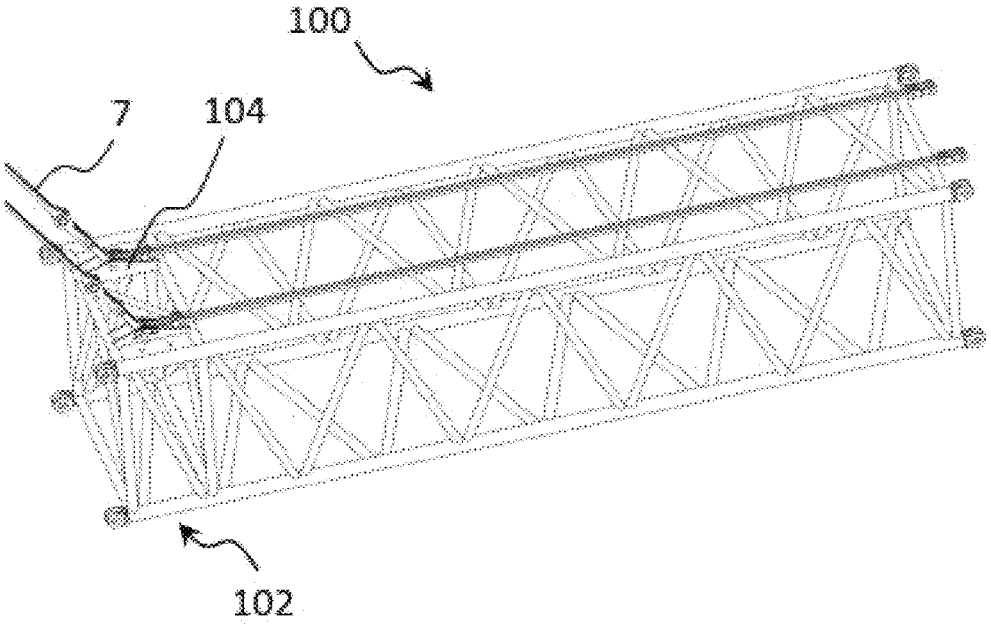
FIG. 1: an example of a special lattice piece known from the prior art in a perspective view.

An example of a special lattice piece 100 is shown in FIG. 1 in a perspective view such as is used in the prior art for the temporary guying of lattice booms of mobile cranes, in particular crawler cranes. This illustration was already initially explained so that repeat statements are dispensed with at this point.

Figure 2:
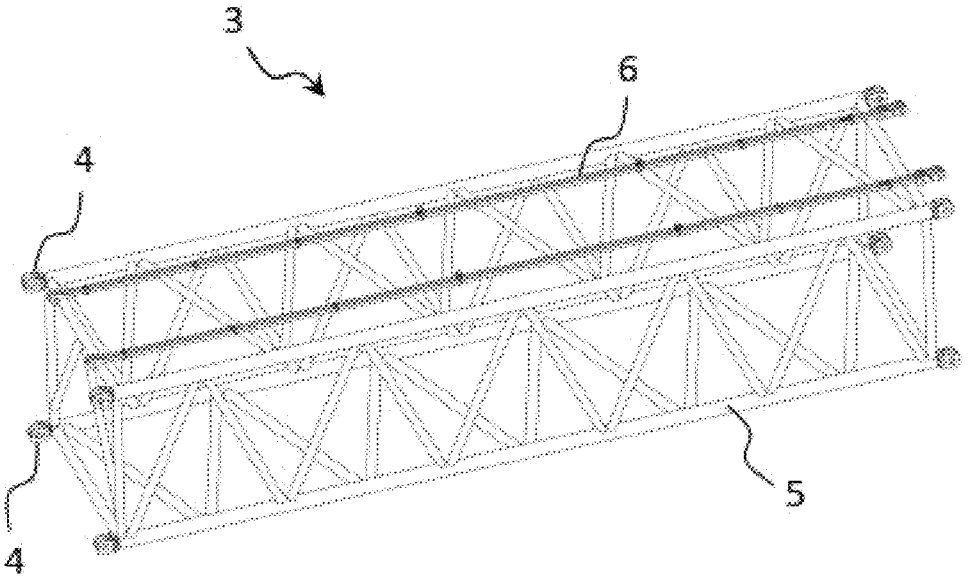
FIG. 2: an example of a standard lattice piece in a perspective view.

FIG. 2 shows a standard lattice piece 3 (only called a "lattice piece" in the following) for the lattice boom or lattice mast boom 2 of a crawler crane 1. The fully equipped boom 2 is assembled from a plurality of such lattice pieces 3 that are pinned by an articulated piece connected to a rotatable superstructure of the crane 1. The boom 2 is in particular guyed via a boom head arranged at its end.

The lattice piece 3 has a parallelepiped-shaped geometry, with the longitudinal edges being formed by four corner bars 5 at whose ends connection means 4 are arranged for pinning to other lattice pieces 3, to an articulated piece, and/or to a boom head. The connection means 4 are configured as connection forks having a central bore and are placed into one another and pinned by a pin for the connection. Adjacent corner bars 5 are connected to one another via diagonal struts and unstrained members. Guying rods 6 are fastened to the upper side of the lattice pieces 3 and are connected to a guying 7 of the crane 1 and released from the lattice paces 3 after the assembling or in the air assembly of the boom 2 to form the final guying of the boom 2. The guying rods 6 of the differently connected lattice pieces 3 are pinned to one other beforehand for this purpose.

Figure 3:
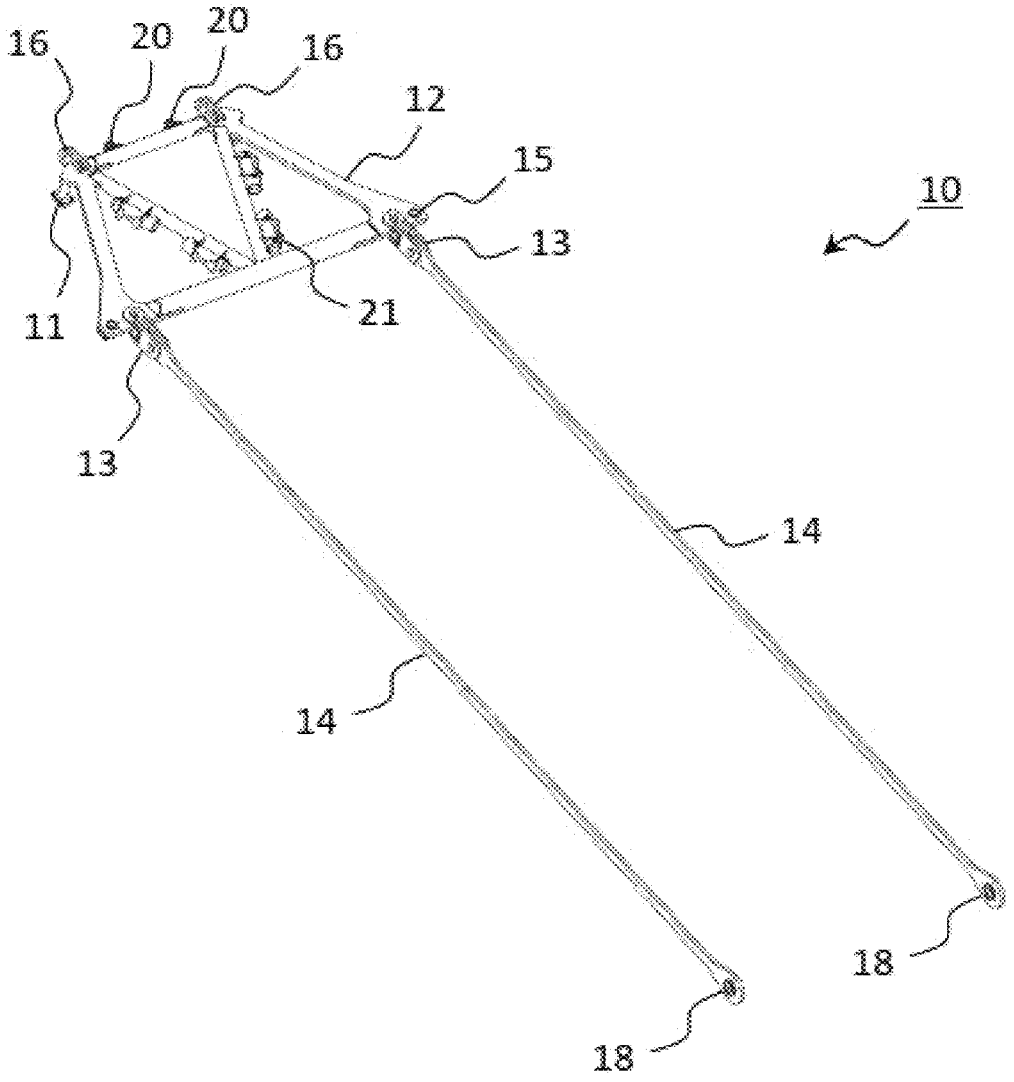
FIG. 3: an embodiment of the apparatus in accordance with the invention in a perspective view.

FIG. 3 shows an embodiment of the apparatus 10 in accordance with the invention, that can also be called an in the air assembly unit, in a perspective view. The assembly 10 has a flat, trapezoidal frame 12 at whose long side two connection elements 14 formed as rods (called connecting rods in the following) are fastened by respective cruciform lugs 13. The cruciform lugs 13 each comprise two pivot axes that are spaced apart from one another, that are oriented perpendicular to one another, and that enable an independent pivoting of the connecting rods 14 both in a common plane (that is toward or away from one another) and in a plane perpendicular thereto.

The trapezoidal frame 12 has two attachment means 16 at the short side to which a guying 7 of the crane 1 can be pinned. It is here in particular a derrick guying 7 or SA frame guying 7 of the crane 1. The distance of the first attachment means 16 ideally corresponds to the distance of the derrick guying 7 or SA frame guying 7. In addition third attachment means 20 are arranged at the short side of the frame 12 via which the apparatus 10 can be connected to an auxiliary crane 50, for example via a chain, a rope, or another suspension means at a hook of the auxiliary crane. The third attachment means 20 are arranged between the first attachment means 16 and thus have a smaller distance from one another than the first attachment means 16.

Two diagonal struts that connect the ends of short side to the center of the long side furthermore extend between the short side and the long side of the frame 12. Four holders 21 for four special pins 22 and the associated securing means 24, 30, which will be looked at in more detail further below, are located at these diagonal struts that act in a reinforcing and stiffening manner. The frame 12 furthermore has a plurality of feet 11 via which the apparatus 10 can be supported on the placing onto a lattice piece 3.

At the ends of the connecting rods 14 remote from the frame 12, they merge into two attachment means 18 that are formed as mutually facing reception holes 18. The reception holes 18 are dimensioned such that they can receive the connection pins used to pin two lattice pieces 3. The apparatus in accordance with the invention can be releasably fastened to the boom 2 via the reception holes 18. For this purpose, the typically used standard pins are replaced on the pinning of two lattice pieces 3 at the upper connection forks 4 with extended special pins 22 that have the same diameter, but a greater length and that project laterally outwardly at the connection points of the lattice pieces 3. The apparatus 10 is attached to these points via the connecting rods 14.

Figure 4:
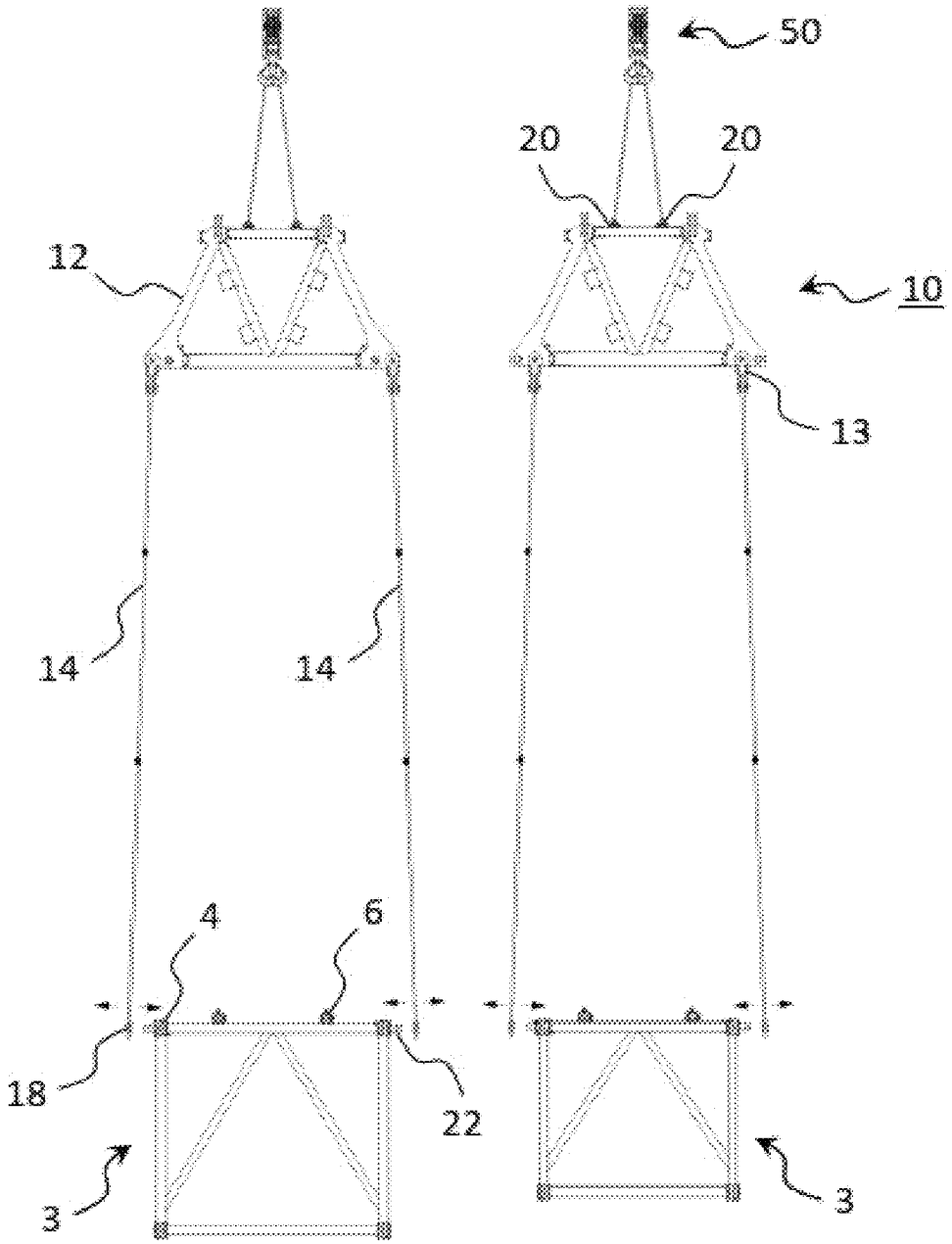
FIG. 4: two frontal views of the apparatus in accordance with the invention on assembly at two lattice pieces of different sizes.

FIG. 4 shows two frontal views of the apparatus 10 in accordance with the invention 10 on the assembly of two lattice pieces 3 of different widths. The special pins 22 can be recognized that project laterally outwardly at the upper connection forks 4 and onto which the connecting rods 14 can be placed via the reception holes 18. Since the connecting rods 14 are pivotably connected to the frame 12 via the cruciform lugs 13, they can be outwardly pivoted to place the reception holes 18 laterally onto the special pins 22. The special pins 22 therefore do not have to be separately dismantled to fasten the apparatus 10. The lower connection forks 4 can be pinned via normal, i.e. shorter, standard pins. In addition to a lateral pivoting, the cruciform lugs 13 permit a pivoting of the connection elements 14 perpendicular thereto along the lattice piece 3. However, an embodiment is also conceivable in which the connecting rods 14 are not pivotably fastened to the frame 12, but are rather designed as flexible and/or as long enough that they can be outwardly bent by the required distance to engage around the special pins 22.

It can likewise be recognized in FIG. 4 that the apparatus 10 is suspended at the hook of an auxiliary crane 50 via the third attachment means 20. The apparatus 10 can thereby be precisely positioned above the desired connection point of the lattice pieces 3 or above the special pins 22.

To adapt the distance of the connecting rods 14 from one another to the respective lattice piece width and thus to be able to use the apparatus 10 with a plurality of lattice pieces 3 or booms 2, the cruciform lugs 13 can be repositioned at the frame 12. For this purpose in this embodiment, two respective different fastening points 15 are provided at which the cruciform lugs 13 can be installed. The distances of the fastening points 15 or of the connecting rods 14 can correspond to two customary standard widths of lattice pieces 3. More than two fastening points 15 per connecting rod 14 can naturally be provided. In this embodiment, the two adjustable distances of the cruciform lugs 13 are greater than the distance of the first attachment means 16. The length and width of the total apparatus 10 approximately corresponds to the length and width of the lattice piece 3.

Figure 5:
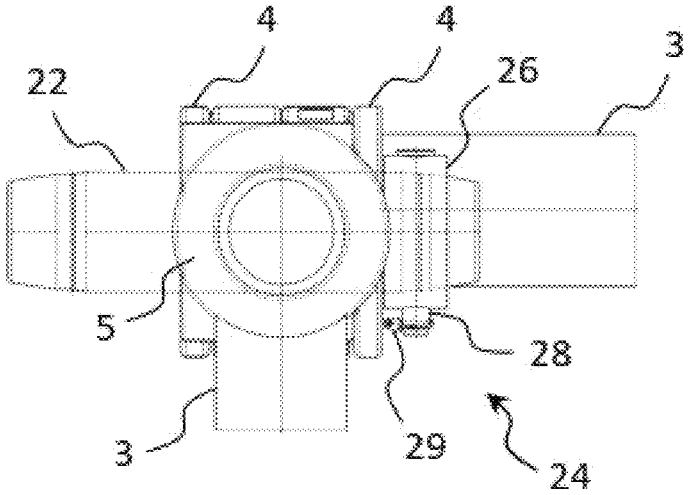
FIG. 5: a detail of the pinning of two lattice pieces by means of the special pin in accordance with the invention.

FIG. 5 shows one of the upper connection points between two lattice pieces 3 along the longitudinal axis of one of the upper corner bars 5. The connection forks 4 of the lattice pieces 3 are joined into one another and pinned by means of a special pin 22. Unlike the normally used standard pin, the special pin 22 is longer and projects further outwardly. The special pin 22 is inwardly secured (right in the illustration) by a first securing means 24. It comprises a hollow cylindrical first sleeve 26 that is placed onto the special pin 22 from the inside. The special pin 22 has a first bore that extends radially through its axis of rotation and that is covered in the correctly placed state of two mutually diametrically opposed bores in the first sleeve 26. A first securing pin 28 pushed through the bores of the first sleeve 26 and the first bore of the special pin 22 prevents the first sleeve 26 from slipping off the special pin 22. The first securing pin 28 is in turn secured against falling out by a linchpin 29. The first sleeve 26 forms an inner abutment for the special pin 22.

The special pin 22 is conically chamfered at both ends to facilitate the plugging into the bores of the connection forks 4. It in particular has the same diameter as a standard pin. The apparatus 10 in accordance with the invention can thereby be flexibly attached to any desired connection point of two lattice pieces 3 (or also between the articulation piece and the lattice piece 3 as well as between the lattice piece 3 and the boom head). For this purpose, only the standard pins at the upper connection forks 4 have to be replaced with the special pins 22 in accordance with the invention. Four special pins 22 together with the sleeves 26, 32, securing pins 28, 34, and linchpins 29, 35 can be supported in special holders 21 at the frame 12 for transport (cf. FIG. 3).

Figure 6:
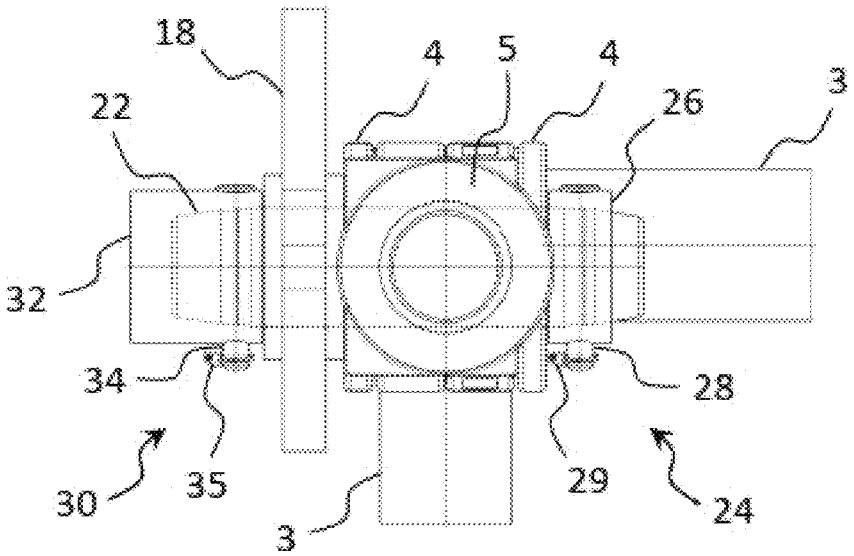
FIG. 6: the detail in accordance with FIG. 5 after assembly of the second attachment means of the apparatus in accordance with Figure.

The same connection point is shown in FIG. 6 with a pinned connecting rod 14 of the apparatus 10 in accordance with the invention. The connecting rod 14 is placed onto the special pin 22 from the outside via the reception hole 18 (left in the illustration). To prevent a release of the connecting rod 14, a second securing means 30 at the outer side is provided that comprises a second sleeve 32 and a second securing pin 34. Analog to the first securing means 24, the second securing pin 34 is pushed through a second bore extending at the outer end of the special pin 22 radially through its axis of rotation and through two corresponding bores of the second sleeve 32 and is secured against falling out by means of a linchpin. The second sleeve 32 forms an outer abutment so that the connection forks 4 and the second attachment means 18 are secured and pinned with shape matching between the first and second sleeves 26, 32.

An embodiment of the method in accordance with the invention for the in the air assembly of the lattice boom 2 of a crawler crane 1 using the apparatus 10 in accordance with the invention is illustrated in FIGS. 7 to 13, with the Figures showing different steps of the method and the associated boom configurations and positions.

A first lattice piece 3 is first installed at an articulation piece pivotably connected to the superstructure of the crane 1. The SA frame guying 7 of the crane 1 is not connected to the boom 2. A second lattice piece 3 is subsequently installed at the first lattice piece 3, with only the two respective upper connection forks 4 being pinned to one another. The previously described special pins 22 are used here (cf. FIG. 6). They are inserted into the bores of the connection forks 4 and are secured by the first securing means 24. The boom 2 first comprising these two lattice pieces 3 is placed on the ground.

The apparatus 10 in accordance with the invention is fastened to the hook (or to the hook-type bottom block) of an auxiliary crane 50 via the third attachment means 20. The apparatus 10 is raised by means of the auxiliary crane 50 and is positioned above the connection point of the two lattice pieces 3 only pinned at the upper connection forks 4. The connecting rods 14 are now pressed or pivoted outwardly to place their ends having the reception holes 18 laterally onto the special pins 22 from the outside. In this process, the special pins 22 are held in position by the clamping force present between the special pins 22 and the connection forks 4. After the placement of the connecting rods 14 onto the special pins 22, they are secured by the two securing means 30. The apparatus 10 is thus installed at the boom 2, with it still being pivotable about the special pins 22 acting as a pivot axis.

Figure 7:
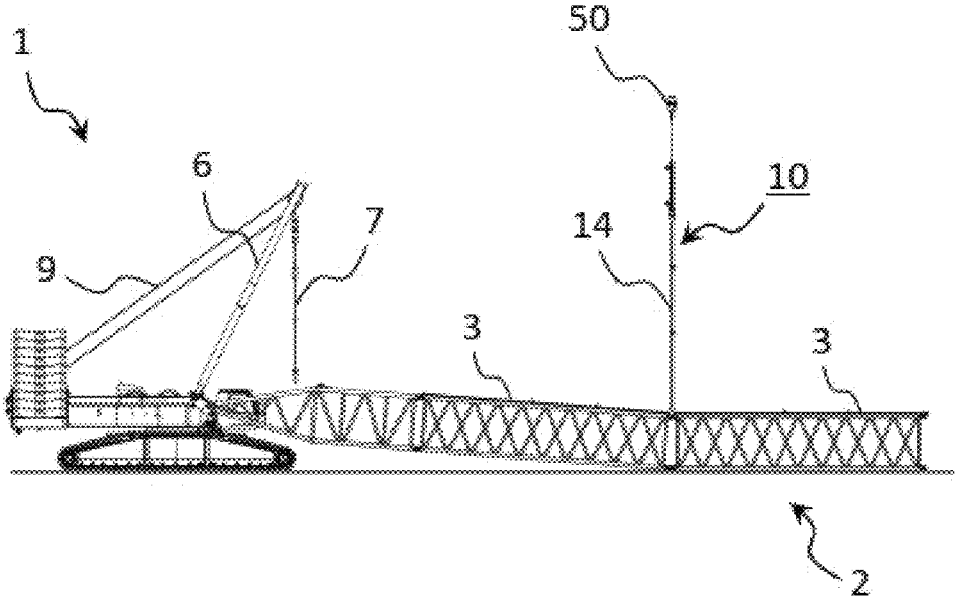
FIGS. 7-13: a plurality of side views of a crawler crane during different steps of the in the air assembly of the lattice boom in accordance with the method in accordance with the invention.

FIG. 7 shows the boom 2 during the in the air assembly after the apparatus 10 has been attached to the special pin 22 as described above. It still hangs on the hook of the auxiliary crane 50 in this process.

Figure 8:
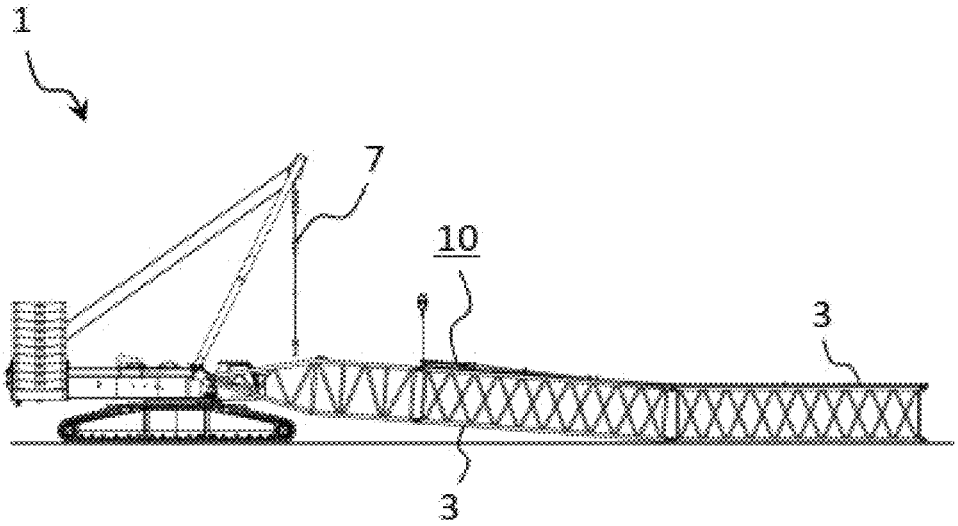

The apparatus 10 is subsequently placed down on the lattice piece 3 facing the guying 7, as is shown n FIG. 8. Due to the feet 11 attached to the frame 12 (cf. FIG. 3), the apparatus 10 is higher than the guying rods 6 fastened to the upper side of the lattice piece 3. The apparatus 10 is now prepared for pinning to the guying 7 of the crane 1.

Figure 9:
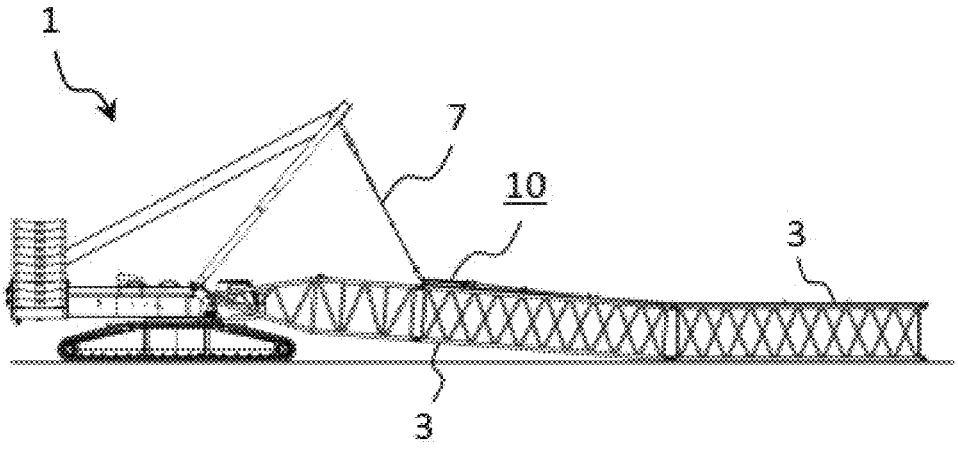
Figure 10:
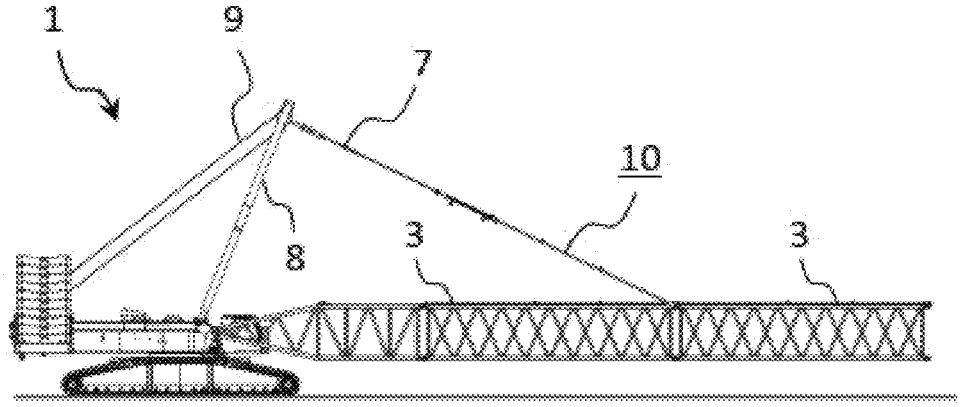

FIG. 9 shows the crane 1 after the apparatus 10 has been removed from the auxiliary crane 50 and has been pinned to the SA frame guying 7 at the first connection means 16. The boom 2 is still placed on the ground.

The guying 7 is subsequently tensioned by retracting the rope 9 of the adjustment of the SA frame 8. In the next step, that can be seen in FIG. 10, the boom 2 is raised via the guying 7 so that it rises from the ground and preferably adopts a substantially horizontal position. The apparatus 10 is now part of the boom guying. A derrick guying or another guying can also be used instead of an SA frame.

Figure 11:
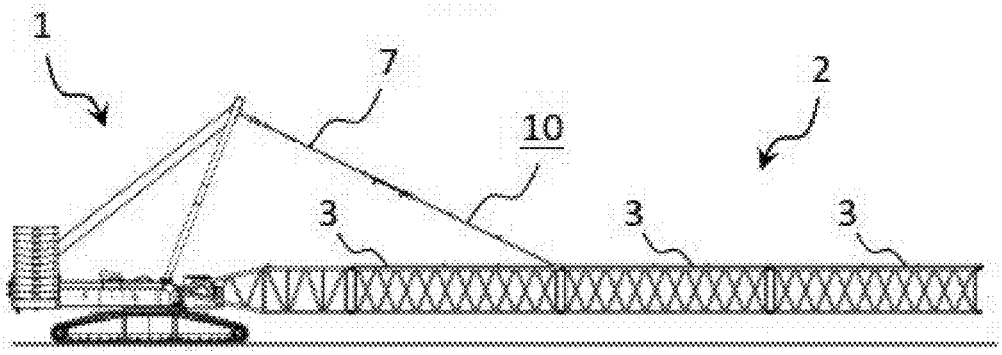
Figure 12:
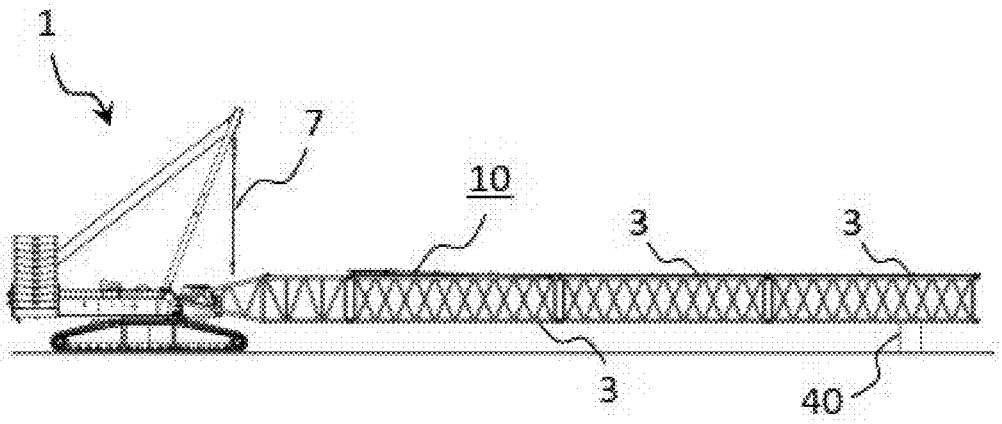
Figure 13:
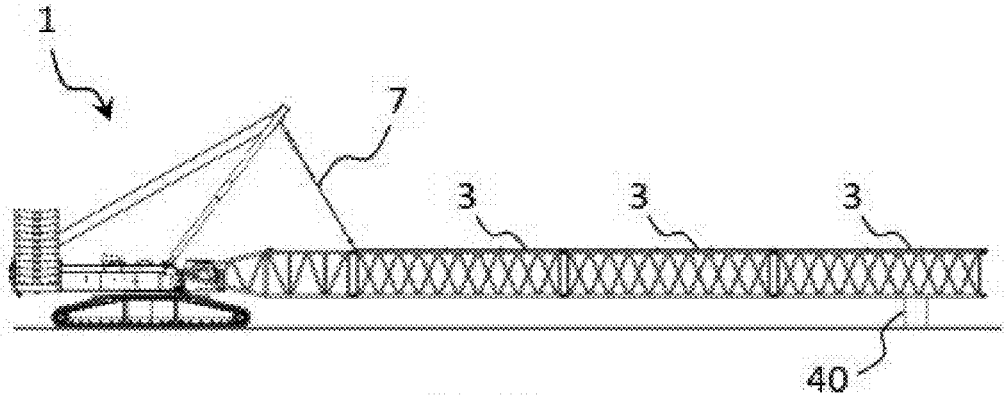

The lower connection forks 4 of the two lattice pieces 3 are now pinned by means of standard pins and further boom parts such as additional lattice pieces 3 and/or a boom head can be installed at the boom 2, preferably by means of the auxiliary crane 50. A boom configuration after pinning of a third lattice piece 3 is shown in FIG. 11, for example.

Once the complete (i.e. desired or maximum permitted) boom length has been reached, the boom 2 is underpinned, i.e. is placed on a frame 40, a trolley, or similar. The apparatus 10 in accordance with the invention is then again placed onto the lattice piece 3 and is released from the guying 7. This state can be seen in FIG. 12.

The apparatus 10 is finally removed from the special pins 22, i.e. dismantled from the boom 2. In this process, the special pins 22 remain in the boom 2 as upper pinning of the lattice pieces 3 and are again secured toward the outside by means of the second securing means 30 after removal of the connecting rods 14. The second sleeve 32 is installed rotated by 180° for this purpose to compensate the missing second attachment means.

The SA frame guying 7 can now be connected to the guying rods 6 that are fastened to the lattice pieces 3 and that are likewise pinned to one another so that the final guying can be established. Alternatively, instead of or in addition to the SA frame guying 7 of this embodiment, a different guying can be attached and used for guying the fully equipped boom 2. After tensioning of the guying, the boom 2 is finally raised and, for example, moved into the desired work position. The apparatus 10 in accordance with the invention is here not part of the final guying and does not remain in the boom 2 during the work deployment of the crane 1. The total weight is thereby reduced in comparison with the known configuration using a special lattice piece 100 fixed in position, as shown in FIG. 1.

The apparatus 10 in accordance with the invention can either be attached a single time to a connection point of two lattice pieces 3 during the in the air assembly. Since the apparatus 10 can be installed at any desired lattice piece 3, it can, however, also be installed at and removed from a plurality of lattice pieces after one another, for example at every additionally installed lattice piece 3.

The apparatus 10 in accordance with the invention can also be used for the restoration of the crane 1 or of the boom 2 to their original condition. In this process, the completely equipped boom 2 that is in particular guyed via the boom head is first placed down, in particular on a placement frame 40, a trolley, or a similar means for underpinning. The boom head and optionally further lattice pieces 3 are then removed from the boom 2. In this respect, an auxiliary crane 50 can also be used. The apparatus 10 in accordance with the invention is then positioned by means of the auxiliary crane 50 above the desired connection point of two lattice pieces 3 of the restored boom 2 and connected to the special pins 22 of the upper connection forks 4 as previously described. For this purpose, the special pins 22 naturally have to have already been used on the setting up of the boom 2 at the corresponding points so that they can be made use of again later on the restoration for the purpose of the installation of the apparatus 10.

The following steps correspond to those of the previously described method shown in FIGS. 7 to 13 for the in the air assembly, only with the boom 2 preferably being supported on a frame 40 in advance on the restoration to the original condition. The apparatus 10 furthermore remains in the restored state during the traveling of the crane 1 as a part of the temporary guying at the boom 2 until the crane 1 has reached its destination position and the boom 2 is again equipped with the aid of the apparatus 10. The steps shown in FIGS. 7-13 are here also again carried out in full or in part and the apparatus 10 is again removed from the boom 2 before continuing the work deployment of the crane 1.

A different combination of steps in the in the air assembly, the restoration, or any other different conversion process of the boom 2 is naturally also conceivable, which is due to the simple handling capability and the huge flexibility of the apparatus 10 in accordance with the invention.

FIGS. 3-13 are drawn to scale, although other relative dimensions may be used.

REFERENCE NUMERAL LIST

1 crane
2 boom
3 lattice piece
4 connection means (connection fork)
5 corner bar
6 guying rod
7 guying
8 SA frame
9 rope
10 apparatus
11 foot
12 frame
13 cruciform lug
14 connection element
15 fastening point
16 first attachment means
18 second attachment means (reception hole)
20 third attachment means
21 holder
22 special pin
24 first securing means
26 first sleeve
28 first securing pin
29 linchpin
30 second securing means
32 second sleeve
34 second securing pin

35 linchpin
40 placement frame
50 auxiliary crane
100 special lattice piece
102 reinforced region
104 attachment point

The invention claimed is:

1. An apparatus for guying a lattice boom of a crane comprising at least two lattice pieces, said apparatus being attachable thereto for an assembly of the lattice boom and being able to be removed again after the assembly of the lattice boom has taken place, comprising a frame and at least two connection elements fastened thereto, with the frame having first attachment means for a releasable connection of the apparatus to a guying of the crane and with the at least two connection elements having second attachment means for a releasable fastening of the apparatus to the lattice boom.

2. The apparatus in accordance with claim 1, wherein the frame is of a trapezoidal structure.

3. The apparatus in accordance with claim 2, wherein the first attachment means are fastened to a short side of the frame and the connection elements being fastened to a long side of the frame.

4. The apparatus in accordance with claim 1, wherein the at least two connection elements are rods or ropes.

5. The apparatus in accordance with claim 1, wherein the at least two connection elements are pivotably fastened to the frame within a common plane.

6. The apparatus in accordance with claim 5, wherein the connection elements are fastened respectively via a cruciform lug having two pivot axes arranged perpendicular to one another.

7. The apparatus in accordance with claim 1, wherein the frame has third attachment means for the fastening of the apparatus to an auxiliary crane.

8. The apparatus in accordance with claim 1, wherein the second attachment means are formed as reception holes that can be placed from outside onto connection pins at connection points of the at least two lattice pieces.

9. The apparatus in accordance with claim 8, wherein at least two special pins are provided that can be used to pin the at least two lattice pieces in connection means of the lattice pieces, with the special pins projecting laterally beyond the lattice pieces that the reception holes of the connection elements can be placed on from the outside.

10. The apparatus in accordance with claim 1, wherein the connection elements are respectively fastenable at at least two different positions at the frame so that a distance of the connection elements from one another is variable.

11. A method for an in the air assembly of a lattice boom of a crane, the method comprising:

a) connecting at least two lattice pieces of the lattice boom to the crane and supporting the lattice boom on the ground;
b) positioning an apparatus for guying the lattice boom of the crane at a connection point of the at least two lattice pieces;
c) fastening the apparatus to the lattice boom via a second attachment means of at least two connection elements;
d) connecting a guying of the crane to a first attachment means of the apparatus;
e) raising the lattice boom by means of the guying, with the apparatus being part of the guying;
f) installing at least one further component to the guyed boom;
g) supporting the lattice boom;
h) dismantling the apparatus from the guying and the lattice boom; and
i) fastening the guying and/or a further guying to the lattice boom and raising the lattice boom.

12. The method in accordance with claim 11, wherein a) takes place while using two special pins to pin the at least two lattice pieces in connection means of the at least two lattice pieces, with the two special pins projecting laterally beyond the lattice pieces that reception holes of the connection elements can be placed on from outside.

13. The method in accordance with claim 12, wherein the lattice pieces have upper and lower connection means of which the upper connection means are pinned to one another by the special pins and the lower connection means are not pinned to one another.

14. The method in accordance with claim 11, wherein after step e), the at least two lattice pieces are pinned to one another.

15. The method in accordance with claim 11, wherein the apparatus is placed on one of the two lattice pieces before the connection to the guying of the crane.

16. The method in accordance with claim 11, wherein the guying is a derrick guying, an A frame guying or an SA frame guying.

17. The method in accordance with claim 11, wherein positioning the apparatus at the connection point of the two lattice pieces is by means of an auxiliary crane, wherein the at least one further component is a lattice piece and/or a boom head, and wherein supporting the boom includes supporting the boom on a frame, the method further comprising releasing the connection to the auxiliary crane.

18. A method for restoring to an original state and guying a lattice boom of a crane, the method comprising:

a) placing down the lattice boom and dismantling a component of the lattice boom;
b) positioning an apparatus for guying the lattice boom of the crane at a connection point of two lattice pieces of the lattice boom;
c) fastening the apparatus to the lattice boom via a second attachment means of connection elements;
d) connecting a guying of the crane to a first attachment means of the apparatus; and
e) raising the lattice boom by means of the guying and guying the lattice boom, with the apparatus being part of the guying.

19. The method in accordance with claim 18, wherein the at least two lattice pieces of the lattice boom are pinned by means of two special pins at which the apparatus is fastened via the two attachment means of the connection elements, the two special pins to pin the two lattice pieces in connection means of the lattice pieces, with the special pins projecting laterally beyond the lattice pieces that the reception holes of the connection elements can be placed on from the outside.

20. The method in accordance with claim 18, wherein placing down the lattice boom includes placing down the lattice boom on a placement frame, wherein dismantling a component of the lattice boom includes dismantling the boom head, and wherein positioning the apparatus at the connection point of the two lattice pieces of the boom is by means of an auxiliary crane, the method further comprising releasing the connection to the auxiliary crane.

* * * * *